US009737897B2

(12) United States Patent
Kim et al.

(10) Patent No.: US 9,737,897 B2
(45) Date of Patent: Aug. 22, 2017

(54) COVER FOR CENTRIFUGAL FILTER

(71) Applicant: SHIN HEUNG PRECISION CO., LTD, Ulsan (KR)

(72) Inventors: Yong Keun Kim, Ulsan (KR); Ho Jin Eum, Ulsan (KR); Kyo Hye Ye, Ulsan (KR)

(73) Assignee: SHIN HEUNG PRECISION CO., LTD., Ulsan (KR)

( * ) Notice: Subject to any disclaimer, the term of this patent is extended or adjusted under 35 U.S.C. 154(b) by 0 days.

(21) Appl. No.: 15/035,388

(22) PCT Filed: Jan. 12, 2015

(86) PCT No.: PCT/KR2015/000290
§ 371 (c)(1),
(2) Date: May 9, 2016

(87) PCT Pub. No.: WO2016/080592
PCT Pub. Date: May 26, 2016

(65) Prior Publication Data

US 2016/0339449 A1 Nov. 24, 2016

(30) Foreign Application Priority Data

Nov. 18, 2014 (KR) ..... 10-2014-0160822

(51) Int. Cl.
*B04B 7/04* (2006.01)
*B04B 9/06* (2006.01)
(Continued)

(52) U.S. Cl.
CPC ..... *B04B 7/04* (2013.01); *B04B 3/00* (2013.01); *B04B 5/005* (2013.01); *B04B 7/02* (2013.01); *B04B 9/06* (2013.01)

(58) Field of Classification Search
CPC B04B 11/04; B04B 9/10; B04B 5/005; B04B 9/06; B04B 3/00; B04B 7/02; B04B 7/04
(Continued)

(56) References Cited

U.S. PATENT DOCUMENTS 2,067,273 A * 1/1937 Carter ..... B04B 1/00 494/10
4,175,040 A * 11/1979 Sammons ..... B04B 5/06 210/371

(Continued)

FOREIGN PATENT DOCUMENTS

JP 2002-166192 A 6/2002
KR 10-2005-0042028 A 5/2005

(Continued)

*Primary Examiner* — Charles Cooley
(74) *Attorney, Agent, or Firm* — Rabin & Berdo, P.C.

(57) ABSTRACT

A cover for a centrifugal filter, in which when water separated from oil is discharged through outlets provided in covers, can reduce the amount of oil leaking out with mixed gas and water. The cover constitutes the centrifugal filter by covering a rotor that rotates so as to filter impurities contained in oil by using a centrifugal force. The rotor is provided with at least one nozzle through which filtered oil is jetted. The cover includes: an inner cover configured to cover the rotor and including a first outlet and a first inlet; an outer cover provided outside the inner cover; and an oil leak prevention member provided in the first outlet.

8 Claims, 6 Drawing Sheets

(51) Int. Cl.
*B04B 3/00* (2006.01)
*B04B 7/02* (2006.01)
*B04B 5/00* (2006.01)

(58) Field of Classification Search
USPC ..... 494/24, 36, 43, 49, 56, 64, 65, 67, 83, 494/84, 901, 60, 74, 79; 210/168, 171, 210/232, 360.1, 380.1, 416.5; 184/6.24
See application file for complete search history.

(56) References Cited

U.S. PATENT DOCUMENTS

| | | | | |
|---|---|---|---|---|
| 7,081,146 | B2 | 7/2006 | Hällgren et al. | |
| 7,156,901 | B2 | 1/2007 | Hällgren et al. | |
| 2004/0237792 | A1 | 12/2004 | Hallgren et al. | |
| 2005/0039604 | A1 | 2/2005 | Hallgren et al. | |
| 2015/0283560 | A1* | 10/2015 | Kim | F01M 1/10 494/1 |
| 2016/0339449 | A1* | 11/2016 | Kim | B04B 3/00 |

FOREIGN PATENT DOCUMENTS

| | | | | |
|---|---|---|---|---|
| KR | 10-2008-0053148 | A | 6/2008 | |
| KR | 10-2010-0136393 | A | 12/2010 | |
| KR | 10-1003524 | B1 | 12/2010 | |
| KR | 10-1470837 | B1 | 12/2014 | |
| WO | WO 2007125260 | A2 * | 11/2007 | B01D 36/045 |

* cited by examiner

COVER FOR CENTRIFUGAL FILTER

TECHNICAL FIELD

The present invention relates generally to a cover for a centrifugal filter. More particularly, the present invention relates to a cover for a centrifugal filter, in which when oil filtered in the centrifugal filter is jetted through a nozzle of a rotor, the cover enables water separated from the oil to be safely discharged to the outside of the centrifugal filter, and further enables dehydrated mixed gas to be safely introduced into the centrifugal filter.

BACKGROUND ART

In general, a centrifugal filter is a device performing the functions of separation, purification, and concentration of liquids that are different in components and specific gravities by using a centrifugal force. The centrifugal filter is also used in filtering impurities out of oil (lubricants or fuel oil), used in engines, and used in various kinds of mechanical devices.

FIG. 1 is a sectional view showing the structure of the centrifugal filter according to a conventional art.

The centrifugal filter shown in FIG. 1 is used in filtering impurities out of oil for engines and mechanical devices.

The centrifugal filter includes: a shaft 10 provided with a flow path 11 therein through which oil is introduced; a rotor 20 configured to rotate around the shaft 10; a stand tube 30 configured to rotate around the shaft 10 with the rotor 20, the stand tube jetting the oil introduced through the shaft into the rotor; and a cover 40 receiving oil jetted from a nozzle 21 of the rotor by housing the rotor 20 therein, the cover including an oil inlet and an oil outlet.

The above-described centrifugal filter receives oil by a drive of a pump (not shown), and filters impurities from the oil by using centrifugal force. The centrifugal filter is configured in such a manner that the rotor rotates at high speed by using a reaction force produced during oil-jetting through the nozzle provided in the rotor.

Although the above-described centrifugal filter can separate and remove impurities in oil, it cannot remove water from the oil. Accordingly, an oil purification system using the centrifugal filter of the conventional art requires an additional oil-water separator.

FIG. 2 is a sectional view showing the structure of a centrifugal filter according to another conventional art.

The centrifugal filter shown in FIG. 2 can simultaneously remove impurities and water in oil, and more specifically, during the rotation of a rotor 50, an impurity A and water B are removed from the oil by being moved to an edge of an inside of the rotor 50 by centrifugal force. Accordingly, the water separated from the oil is discharged through a flow path 51 provided in the rotor, and when the impurity A accumulated on the edge of the inside of the rotor reaches a predetermined amount, an impurity discharge hole 52 is opened, and thus the impurity is discharged to the outside of the centrifugal filter.

As described above, the centrifugal filter has an advantage in that it is capable of removing water in oil even without using the additional oil-water separator. However, the centrifugal filter has an inconsistency in that it requires supplying water for the separation of water or removal of the impurities from oil, and further has a disadvantage in that an emulsion occurs due to the increase of a region on which water and oil come into contact with each other.

RELATED ART DOCUMENT

[Patent Document 1] Korean Patent No. 1003524 (published on Dec. 30, 2010)

DISCLOSURE

Technical Problem

Accordingly, the present invention has been made keeping in mind the above problems occurring in the related art, and the present invention is intended to propose a cover for a centrifugal filter, in which when water separated from oil is discharged through outlets provided in covers, the cover for the centrifugal filter can reduce the amount of oil leaking out with mixed gas and water.

The present invention is further intended to propose a cover for a centrifugal filter, in which when mixed gas and water are discharged from the centrifugal filter, the cover for the centrifugal filter can induce the mixed gas and water to be evenly discharged throughout an entire circumference of a cover without allowing the mixed gas and water to concentrate on a specific region of the cover.

The present invention is still further intended to propose a cover for a centrifugal filter, in which when resupplying dehydrated mixed gas to an inside of the centrifugal filter, the cover for the centrifugal filter enables the introduction of the mixed gas to the inside thereof under even pressure throughout an entire circumference of the cover.

Technical Solution

In order to achieve the above object, according to one aspect of the present invention, there is provided a cover for a centrifugal filter, the cover constituting the centrifugal filter by covering a rotor that rotates so as to filter impurities contained in oil by using a centrifugal force, the rotor being provided with at least one nozzle through which filtered oil is jetted, the cover including: an inner cover configured to cover the rotor, the inner cover including a first outlet for discharging water separated from oil jetted from the nozzle, and a first inlet through which mixed gas is introduced into the inner cover; an outer cover provided outside the inner cover such that an outlet chamber communicating with the first outlet and an inlet chamber communicating with the first inlet are provided outside the inner cover, the outer cover being provided with a second outlet communicating with the outlet chamber, and a second inlet communicating with the inlet chamber; and an oil leak prevention member provided in the first outlet by protruding from an inner surface of the inner cover in a direction toward an inner part of the inner cover.

Meanwhile, according to the cover for the centrifugal filter, an enlarged part may be provided on an inner end of the oil leak prevention member by protruding from an outer surface of the oil leak prevention member in a radial direction toward an outside of the oil leak prevention member.

In the meantime, according to the cover for the centrifugal filter, the oil leak prevention member may be configured in a shape of a cylindrical pipe.

Meanwhile, according to the cover for the centrifugal filter, the first outlet may include a multiplicity of first outlets, the multiplicity of first outlets being formed in the inner cover in such a manner that the first outlets are spaced apart from each other along a circumference of the inner cover on a same horizontal plane.

In the meantime, according to the cover for the centrifugal filter, the multiplicity of first outlets may have respective diameters increasing in proportion to distances from the second outlet.

Meanwhile, according to the cover for the centrifugal filter, the first inlet may include a multiplicity of first inlets, the multiplicity of first inlets being formed in the inner cover in such a manner that the first inlets are spaced apart from each other along a circumference of the inner cover on a same horizontal plane.

In the meantime, according to the cover for the centrifugal filter, the multiplicity of first inlets may have respective diameters increasing in proportion to distances from the second inlet.

Meanwhile, according to the cover for the centrifugal filter, the cover may further include: a sensor dog provided on an outer surface of the rotor; and a rotation detection sensor provided in such a manner that the rotation detection sensor passes through both the outer cover and the inner cover, the rotation detection sensor detecting a rotation number of the rotor by sensing the sensor dog during rotation of the rotor.

According to the present invention having the above-described characteristics, the oil leak prevention member can prevent oil spattered out through a gap between an upper end of the rotor and a shaft from being introduced into the first outlets, and thus an amount of oil discharged to the outside of the centrifugal filter with water and mixed gas can be reduced.

In addition, the first outlet provided in the inner cover and through which water and mixed gas are discharged includes the multiplicity of first outlets formed along the circumference of the inner cover. Particularly, since the multiplicity of first outlets have respective diameters increasing in proportion to distances from the second outlet, larger amounts of the mixed gas can be prevented from being discharged through a specific region, for example, through a first outlet formed on a position close to the second outlet than through remaining first outlets. Accordingly, the flow of the mixed gas in the centrifugal filter can be prevented from becoming unstable.

Likewise, the first inlet provided in the inner cover and through which the mixed gas is introduced into the inner cover includes the multiplicity of first inlets formed along the circumference of the inner cover. Particularly, since the first inlets have respective diameters increasing in proportion to distances from the second inlet, the amount of the mixed gas introduced into the centrifugal filter through each of the first inlets can remain even irrespective of a position of each of the first inlets, and thus the flow of the mixed gas in the centrifugal filter can become stable.

DESCRIPTION OF THE REFERENCE NUMERALS IN THE DRAWINGS

| | |
|---|---|
| 20: Rotor | 21: Nozzle |
| 110: Inner cover | 111: First outlet |
| 112: First inlet | 120: Outer cover |
| 121: Second outlet | 122: Second inlet |
| 130: Oil leak prevention member | 131: Enlarged part |
| 141: Sensor dog | 142: Rotation detection sensor |

MODE FOR INVENTION

Hereinafter, an exemplary embodiment of the present invention will be described in detail with reference to the accompanying drawings. In the following description of the present invention, detailed descriptions of known functions and components incorporated herein will be omitted when it may make the subject matter of the present invention unclear.

Figure 3:
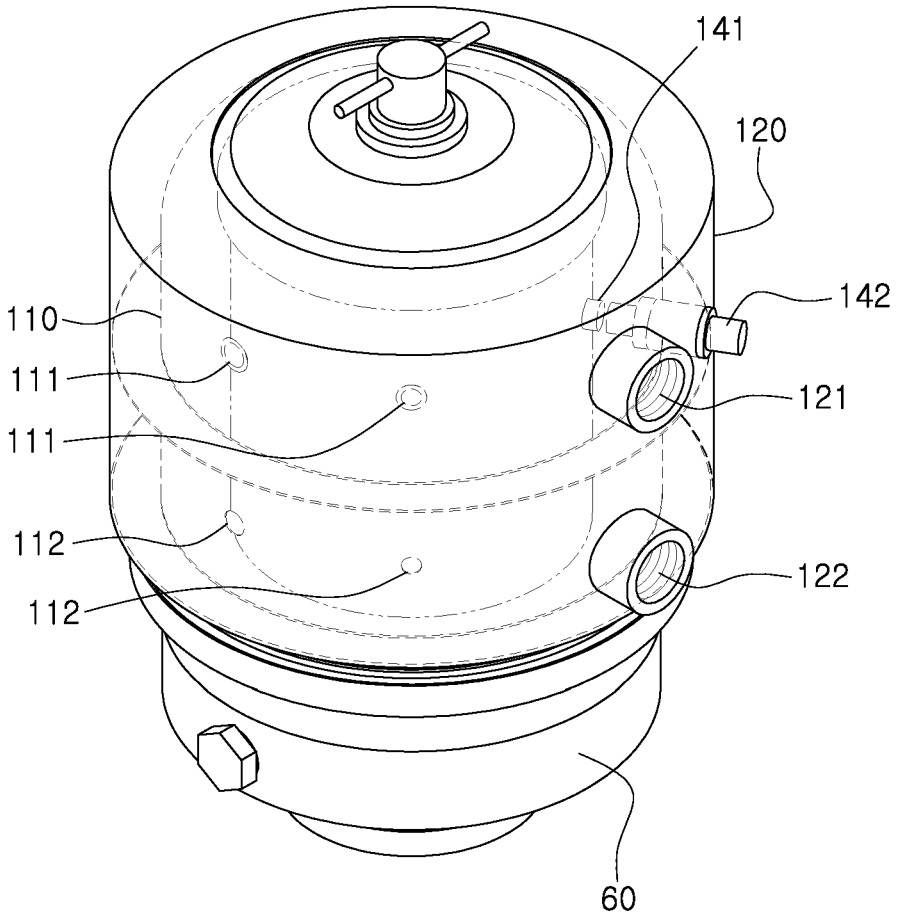
FIG. 3 is a perspective view showing the structure of a cover for a centrifugal filter according to the present invention.
Figure 4:
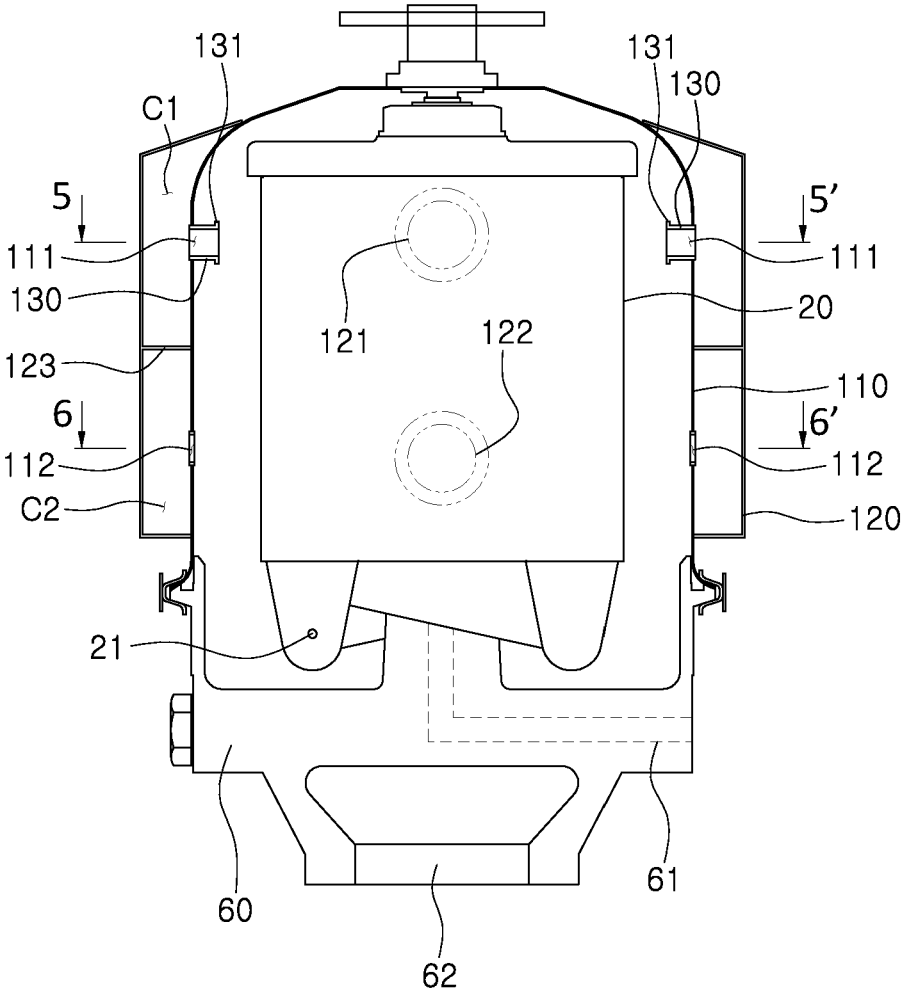
FIG. 4 is a sectional view showing the structure of the cover for the centrifugal filter according to the present invention.
Figure 5:
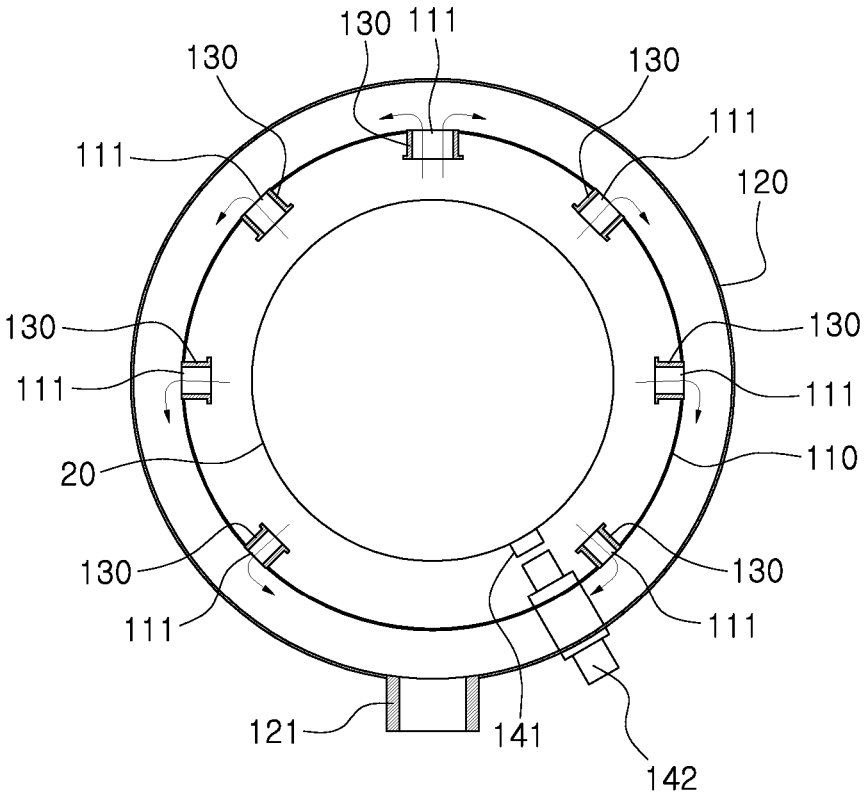
FIG. 5 is a sectional view taken along line 5-5' of FIG. 4.
Figure 6:
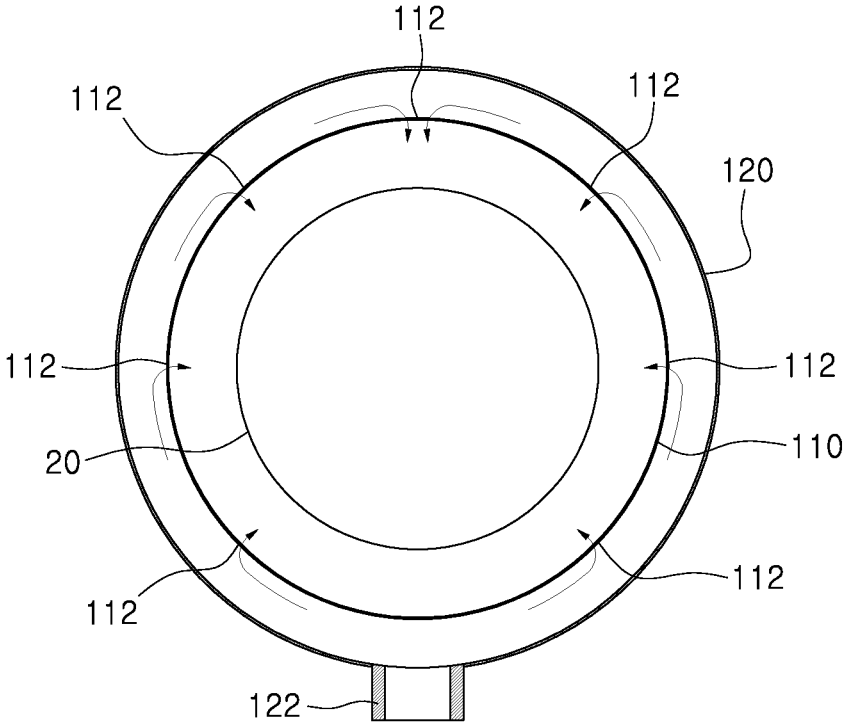
FIG. 6 is a sectional view taken along line 6-6' of FIG. 4.

FIG. 3 is a perspective view showing the structure of a cover for a centrifugal filter according to the present invention; FIG. 4 is a sectional view showing the structure of the cover for the centrifugal filter according to the present invention; FIG. 5 is a sectional view taken along line 5-5' of FIG. 4; and FIG. 6 is a sectional view taken along line 6-6' of FIG. 4.

When oil filtered in a rotor 20 is jetted through a nozzle 21, the cover for the centrifugal filter according to the present invention allows water separated from the oil to be discharged with mixed gas, and includes an inner cover 110, an outer cover 120, and an oil leak prevention member 130.

For reference, the applicant of the present invention discovered that water is separated from oil when the filtered oil is jetted through the nozzle 21 provided beneath the rotor 20. Based on this, the applicant has proposed the cover for the centrifugal filter, whereby when filtering oil by using the centrifugal filter, the cover enables oil and water to be additionally separated by allowing the water separated from oil to be discharged to an outside of the centrifugal filter through an additional route.

Furthermore, the above-described mixed gas is a combination of droplets (fluid drops), water (water vapor) separated from oil, and the vapor of oil produced while the filtered oil is jetted through the nozzle.

Hereinafter, detailed description will be given concerning the inner cover 110, the outer cover 120, and the oil leak prevention member 130 constituting the cover for the centrifugal filter according to the present invention.

The inner cover 110 is configured in a cylindrical shape, the inner cover being closed at an upper end thereof, and being open at a lower end thereof, and forming a space housing the rotor 20 by being combined with a filter base 60 constituting a substructure of the centrifugal filter.

Meanwhile, the filter base 60 includes an oil inlet 61 through which oil to be filtered is introduced, and an oil outlet 62 through which filtered oil is discharged. A shaft guiding oil into the rotor 20 while supporting the rotation of the rotor 20 is combined with the filter base at a lower end thereof, and an upper end of the shaft whose the lower end is combined with the filter base 60 is combined with the upper end of the inner cover 110.

Figure 1:
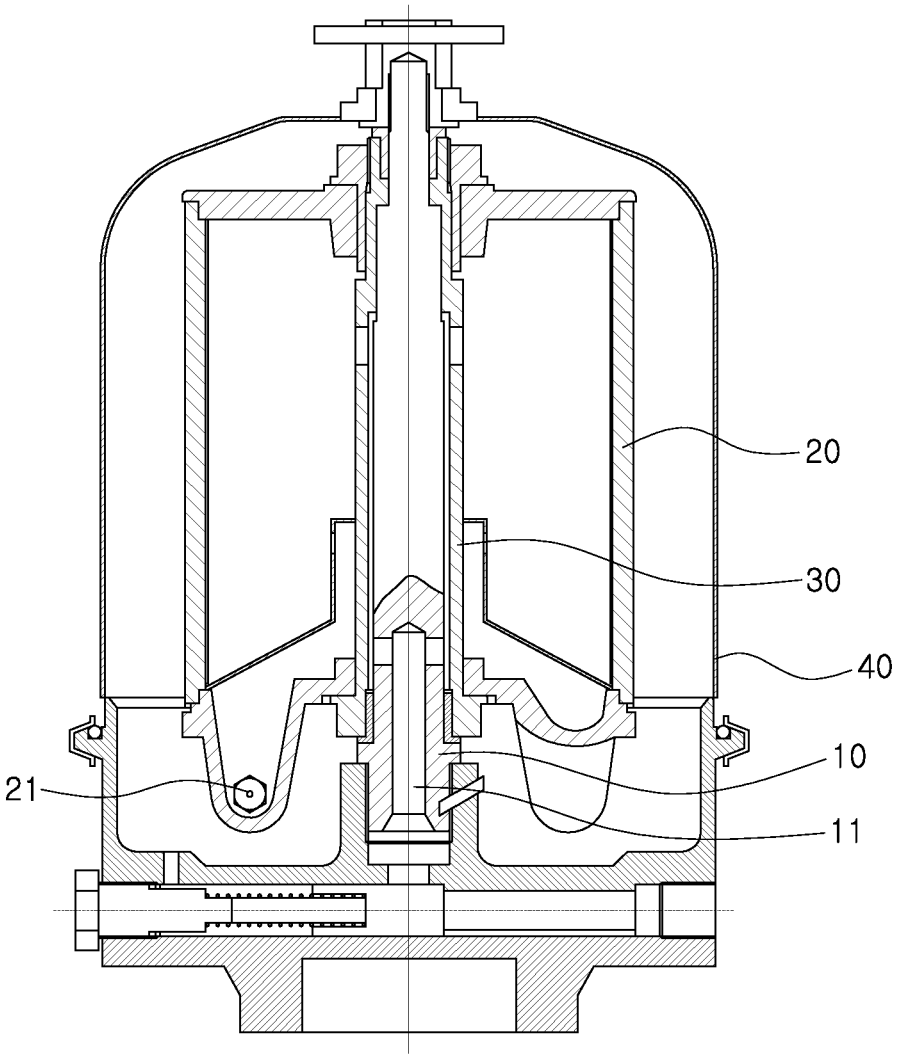
FIG. 1 (PRIOR ART)
FIG. 1 is a sectional view showing the structure of a centrifugal filter according to a conventional art.
Figure 2:
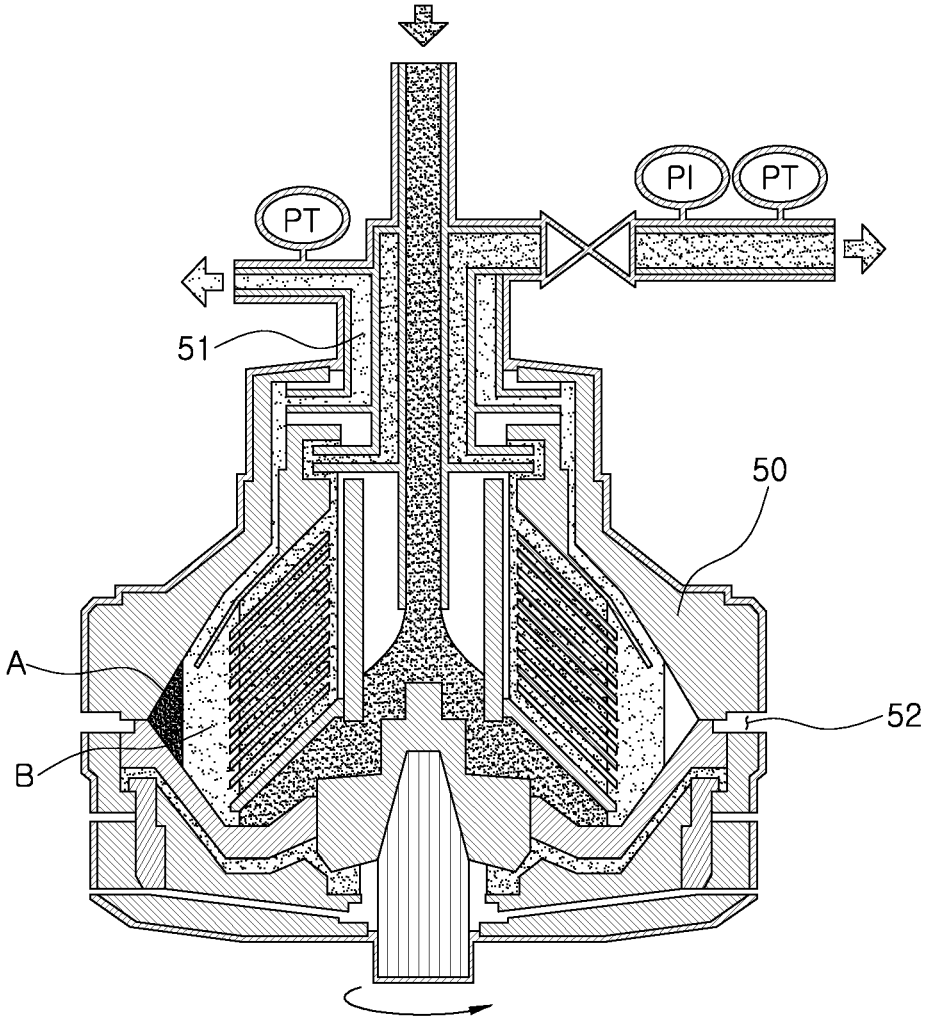
FIG. 2 (PRIOR ART)
FIG. 2 is a sectional view showing the structure of a centrifugal filter according to another conventional art.

Since the structure of the centrifugal filter including the filter base, the shaft, and the rotor is shown in detail in FIG. 1, and the centrifugal filter having the above-mentioned structure is well-known as being used widely by those skilled in the art, further description thereof will be omitted.

Meanwhile, the inner cover 110 includes: a first outlet 111 that allows water and mixed gas to be discharged to an outside of the inner cover 110 while the water separated from oil flows with the mixed gas; and a first inlet 112 that allows dehydrated mixed gas to be introduced into the inner cover 110. The first outlet 111 is formed in an upper part of an outer surface of the inner cover 110, and the first inlet 112 is formed in a lower part of the outer surface of the inner cover 110.

The first outlet 111 formed in the inner cover 110 may include a multiplicity of first outlets, and the first outlets 111 may be configured to be spaced apart from each other along a circumference of the inner cover 110 on the same horizontal plane. As will be described hereinafter, the first outlets 111 formed along the circumference of the inner cover 110 may be configured to have respective diameters increasing and thus to have flow cross-sectional areas of the mixed gas increasing in proportion to distances from a second outlet 121.

For reference, the second outlet 121 is connected to an air blower not shown, and thus is configured to forcefully discharge the mixed gas in the centrifugal filter to outside of the outer cover. Accordingly, a great suction force is applied to the first outlet 111 formed at a position relatively close to the second outlet 121, whereas a little suction force is applied to the first outlet 111 formed at a position relatively far from the second outlet 121. Accordingly, when a diameter of each of the first outlets 111 is formed in the same size irrespective of a distance from the second outlet 121, only through the first outlet 111 formed at a position close to the second outlet 121 are large amounts of the mixed gas and water discharged, and thus the flow of the mixed gas in the inner cover 110 may become unstable.

Accordingly, according to the present invention, when forming the multiplicity of first outlets 111 along the circumference of the inner cover 110, the diameter of the first outlet 111 formed at the position relatively close to the second outlet in considering a distance from the second outlet 121 is formed in a small size, which increases flow resistance of mixed gas. Conversely, the diameter of the first outlet 111 formed at a position far from the second outlet 121 is formed in a large size, which decreases the flow resistance of mixed gas. Accordingly, irrespective of a position of each of the first outlets 111, similar amounts of the mixed gas and water can be discharged from the inner cover 110 through each of the first outlets 111.

Meanwhile, the first inlet 112 formed in the inner cover 110 may include a multiplicity of first inlets 112, and the first inlets 112 may be configured to be spaced apart from each other along the circumference of the inner cover 110 on the same horizontal plane. As will be described hereinafter, the multiplicity of first inlets 112 formed along the circumference of the inner cover 110 may be configured to have respective diameters increasing and thus to have flow cross-sectional areas of the mixed gas increasing in proportion to distances from a second inlet 122.

As in configuration of each of the first outlets 111 described heretofore, the above-mentioned configuration of each of the first inlets is intended to keep flow of the mixed gas in the inner cover 110 stable. Here, the diameter of the first inlet 112 formed at a position relatively close to the second inlet in considering a distance from the second inlet 122 is formed in a small size, which increases flow resistance of mixed gas. Conversely, the diameter of the first inlet 112 formed at a position far from the second inlet 122 is formed in a large size, which decreases the flow resistance of mixed gas. Accordingly, irrespective of a position of each of the first inlets 112, a similar amount of the mixed gas can be introduced into the inner cover 110 through each of the first inlets 112.

The outer cover 120 forms an outlet chamber C1, and an inlet chamber C2 around the outer surface of the inner cover 110, wherein the mixed gas and water discharged from the first outlet 111 temporarily stay in the outlet chamber, and the mixed gas to be introduced into the inner cover 110 through the first inlet 112 temporarily stays in the inlet chamber C2. The outer cover is configured in a cylindrical shape so as to cover the inner cover 110 such that the outer cover is spaced apart from the outer surface of the inner cover 110 at a predetermined distance. Here, the upper end and the lower end of the outer cover are welded to the outer surface of the inner cover 110. The outer cover is divided into an upper part and a lower part by a partition wall 123, and thus each of the outlet chamber C1 and the inlet chamber C2 is formed.

The outer cover 120 is provided with the second outlet 121 in an upper part of the outer surface thereof, the second outlet communicating with the outlet chamber C1, and is provided with the second inlet 122 in a lower part of the outer surface thereof, the second inlet communicating with the inlet chamber C2. The second outlet 121 is connected with the air blower not shown, and the second inlet 122 is connected with the water remover not shown.

When the mixed gas and water are discharged to the outlet chamber C1 through the first outlet 111, the oil leak prevention member 130 prevents oil from being discharged with the mixed gas and the water. The oil leak prevention member is provided in each of the first outlets 111 by protruding from an inner surface of the inner cover 110 in a direction toward an inner part of the inner cover 110.

For reference, during the rotation of the rotor 20, some of oil is spattered out through a gap between an upper end of the rotor 20 and the shaft, and the oil spattered out from the upper end of the rotor 20 flows down on the inner surface of the inner cover 110.

Meanwhile, without the oil leak prevention member 130, some of the oil flowing down on the inner surface of the inner cover 110 may leak out through the first outlet 111 with the mixed gas and water discharged through the first outlet 111.

Accordingly, according to the present invention, the oil leak prevention member 130 prevents the oil flowing down on the inner surface of the inner cover 110 from being introduced into the first outlet 111 by being provided in the first outlet 111, thereby preventing oil leakage through the first outlet 111.

In the meantime, the oil leak prevention member 130 is configured in a shape of a cylindrical pipe such that the oil efficiently flows down on an outer surface of the oil leak prevention member 130 when the oil flowing down on the inner surface of the inner cover 110 reaches the oil leak prevention member 130.

In addition, an enlarged part 131 is provided on an inner end of the oil leak prevention member 130 by protruding from the outer surface of the oil leak prevention member 130 in a radial direction toward an outside of the oil leak prevention member 130. The enlarged part 131 prevents oil flowing down on the outer surface of the oil leak prevention member 130 from being introduced into the oil leak prevention member 130 via the inner end thereof.

Meanwhile, during operation of the centrifugal filter, a sensor dog 141 and a rotation detection sensor 142 may be further provided so as to detect a rotation number of the rotor 20.

The sensor dog 141 is provided by being fixed on an outer surface of the rotor 20 so as to rotate with the rotor 20.

The rotation detection sensor 142 is provided in such a manner that an inner end thereof approaches the outer surface of the rotor 20 by passing through both the outer cover 120 and the inner cover 110.

According to the sensor dog 141 and the rotation detection sensor 142, during the rotation of the rotor 20, the rotation detection sensor 142 produces a signal in response to the sensor dog 141, and thus can detect the rotation number of the rotor 20 by using the signal produced by the rotation detection sensor 142.

The cover for a centrifugal filter according to the present invention having the above-mentioned structure constitutes the centrifugal filter in such a manner that the lower end of the inner cover 110 is combined with the filter base 60, and the upper end of the shaft combined with the filter base 60 and the upper end of the inner cover 110 are combined with each other.

Meanwhile, the second outlet 121 formed on the outer cover 120 is connected with the air blower, and thus is supplied with a suction force produced by operation of the air blower, and the second inlet 122 is connected with the water remover, and thus is supplied with mixed gas from which water is removed by the water remover.

In the meantime, the rotor 20 is rotated by the operation of the centrifugal filter, and while water separated from oil jetted through the nozzle 21 of the rotor 20 flows with the mixed gas by the suction force produced in the first outlet 111, the water is discharged to the outlet chamber C1 through the first outlet 111.

Accordingly, the mixed gas and the water introduced into the outlet chamber C1 are discharged to the outside of the outer cover 120 through the second outlet 121, and then pass through the water remover. The mixed gas from which the water is removed by the water remover is introduced into the inlet chamber C2 through the second inlet 122, and the mixed gas introduced into the inlet chamber C2 is supplied into the inner cover 110 through the first inlet 112.

Meanwhile, each of the first outlets 111 and the first inlets 112 is configured to be distributed along the circumference of the inner cover 110, and is configured to have a different diameter depending on a distance from each of the second outlet 121 and the second inlet 122. Accordingly, when mixed gas and water are discharged to the outlet chamber C1 through the first outlet 111, and when the mixed gas of the inlet chamber C2 is introduced into the inner cover 110 through the first inlet 112, the flow of the mixed gas in the centrifugal filter can be prevented from becoming unstable due to concentration of the mixed gas in any one direction. The oil leak prevention member 130 can prevent the air blower or the water remover from being contaminated by preventing oil spattered out from the upper end of the rotor 20 from being introduced into the outlet chamber C1 through the first outlet 111, and further can prevent an amount of oil from decreasing due to the oil leakage.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A cover for a centrifugal filter, the cover constituting the centrifugal filter by covering a rotor that rotates so as to filter impurities contained in oil by using a centrifugal force, the rotor being provided with at least one nozzle through which filtered oil is jetted, the cover comprising:

an inner cover configured to cover the rotor, the inner cover including a first outlet for discharging water separated from oil jetted from the nozzle, and a first inlet through which mixed gas is introduced into the inner cover;

an outer cover provided outside the inner cover such that an outlet chamber communicating with the first outlet and an inlet chamber communicating with the first inlet are provided outside the inner cover, the outer cover being provided with a second outlet communicating with the outlet chamber, and a second inlet communicating with the inlet chamber; and an oil leak prevention member provided in the first outlet by protruding from an inner surface of the inner cover in a direction toward an inner part of the inner cover.

2. The cover of claim 1, wherein an enlarged part is provided on an inner end of the oil leak prevention member by protruding from an outer surface of the oil leak prevention member in a radial direction toward an outside of the oil leak prevention member.

3. The cover of claim 1, wherein the oil leak prevention member is configured in a shape of a cylindrical pipe.

4. The cover of claim 1, wherein the first outlet comprises a multiplicity of first outlets, the multiplicity of first outlets being formed in the inner cover in such a manner that the first outlets are spaced apart from each other along a circumference of the inner cover on a same horizontal plane.

5. The cover of claim 4, wherein the multiplicity of first outlets have respective diameters increasing in proportion to distances from the second outlet.

6. The cover of claim 1, wherein the first inlet comprises a multiplicity of first inlets, the multiplicity of first inlets being formed in the inner cover in such a manner that the first inlets are spaced apart from each other along a circumference of the inner cover on a same horizontal plane.

7. The cover of claim 6, wherein the multiplicity of first inlets have respective diameters increasing in proportion to distances from the second inlet.

8. The cover of claim 1, further comprising:

a sensor dog provided on an outer surface of the rotor; and a rotation detection sensor provided in such a manner that the rotation detection sensor passes through both the outer cover and the inner cover, the rotation detection sensor detecting a rotation number of the rotor by sensing the sensor dog during rotation of the rotor.

* * * * *